US009426587B2

(12) United States Patent
Stoffels et al.

(10) Patent No.: US 9,426,587 B2
(45) Date of Patent: Aug. 23, 2016

(54) ELECTRONICS IN A RECEIVER-IN-CANAL MODULE

(71) Applicant: Sonion Nederland B.V., Hoofddorp (NL)

(72) Inventors: Nicolaas Maria Jozef Stoffels, Haarlem (NL); Laurens de Ruijter, Haarlem (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 14/161,947

(22) Filed: Jan. 23, 2014

(65) Prior Publication Data

US 2014/0205122 A1 Jul. 24, 2014

Related U.S. Application Data

(60) Provisional application No. 61/756,258, filed on Jan. 24, 2013.

(51) Int. Cl.
*H04R 25/00* (2006.01)

(52) U.S. Cl.
CPC ..... *H04R 25/608* (2013.01); *H04R 2225/021* (2013.01); *H04R 2460/03* (2013.01)

(58) Field of Classification Search
CPC .. H04R 25/554; H04R 25/453; H04R 25/604; H04R 1/10; H04R 2201/10; H04R 2225/41; H04R 2225/61; H04R 2225/63; H04R 25/407; H04R 25/505; H04R 25/556; H04R 25/608; H04R 25/70; H04R 1/1041; H04R 1/1066; H04R 2201/107
USPC ..... 381/312, 319, 326, 328, 330, 331, 380, 381/381
See application file for complete search history.

(56) References Cited

U.S. PATENT DOCUMENTS

| | | | | |
|---|---|---|---|---|
| 6,144,748 | A * | 11/2000 | Kerns | 381/312 |
| 8,855,323 | B2 * | 10/2014 | Kroman | H04R 25/305 381/312 |
| 2012/0082329 | A1 * | 4/2012 | Neumeyer | H04R 25/65 381/314 |
| 2012/0300965 | A1 | 11/2012 | Samuels | |
| 2012/0328118 | A1 * | 12/2012 | Pedersen | 381/71.11 |
| 2013/0251165 | A1 * | 9/2013 | Jorgensen | H04R 29/001 381/59 |

* cited by examiner

*Primary Examiner* — Davetta W Goins
*Assistant Examiner* — Phylesha Dabney
(74) *Attorney, Agent, or Firm* — Nixon Peabody LLP

(57) ABSTRACT

A hearing aid assembly comprising a Receiver-in-canal part provided with electronics.

17 Claims, 2 Drawing Sheets

ELECTRONICS IN A RECEIVER-IN-CANAL MODULE

CROSS-REFERENCE TO RELATED APPLICATION

This application claims the benefit of U.S. Provisional Patent Application No. 61/756,258, filed Jan. 24, 2013, entitled "Electronics in a Receiver-in-Canal Module" which is hereby incorporated by reference in its entirety.

FIELD OF THE DISCLOSURE

The present disclosure relates to a hearing aid assembly comprising a Receiver-in-canal (RIC) part provided with electronics.

BACKGROUND

Modern hearing aids include a Digital Signal Processor (DSP). This integrated circuit is especially designed for audio processing purposes. It is not arranged with many features to perform non-audio tasks. RIC modules have a built in identification. The DSP can recognize the correct RIC module by reading a resistor value inside the RIC module.

The DSP of a hearing aid is not suitable for reading sensors and processing the measurement data. Nowadays many sensors are available which could be used in a hearing aid to make the hearing aid more intelligent. Also the DSP of a hearing aid is busy with audio processing. However, it is difficult to let the DSP perform other tasks than the normal audio processing, such as dealing with a complex user interface. Another problem is the power consumption of the DSP. It would be advantageous for battery life to turn off the DSP in periods in which there is no need for audio processing. This is however only possible if some intelligent part in the hearing aid monitors the state of the hearing aid and its surroundings to determine whether the DSP has to be turned on again. At this moment the DSP does not support that kind of functionality.

Identification of a RIC module by the DSP is done by reading a resistor value. At current date it is getting more and more difficult to find a resistor value which is not yet in use and assigned to a certain type of RiC-module. A hearing aid consumes a lot of energy. Battery life is short. The DSP will not go in low power mode or off mode when no audio processing is needed.

SUMMARY

It is an object of the present disclosure to provide a more robust and less complex means for connecting a dome to a hearing aid enabling air-tight and sound-tight connection. The above-mentioned object is complied with by providing electronics in the hearing aid. And particularly in a RiC part of a RiC-hearing aid. The electronics preferably comprise an electronic-auxiliary-function-unit.

The electronics provided in the RIC are preferably arranged to perform functions that are less suited to be performed by a DSP. These functions are in the field of reading sensors, interpreting the results, performing algorithms, controlling the power mode of the DSP, supporting means for user interaction with the hearing aid, performing a test of the receiver, actively protecting the receiver and registering parameters important for liability issues.

These functions can also be performed while the DSP of the hearing aid is in sleep or off mode and even when the hearing aid is not on the ear of the user.

In regular hearing aids a user interface may comprises an on/off switch, a volume control, a program selection knob for e.g. switching between omni-mode and directional mode. In this application the user interface is regarded as a sensor.

BRIEF DESCRIPTION OF THE DRAWINGS

The present disclosure will now be explained in further details with reference to the accompanying figures where.

Figure 1:
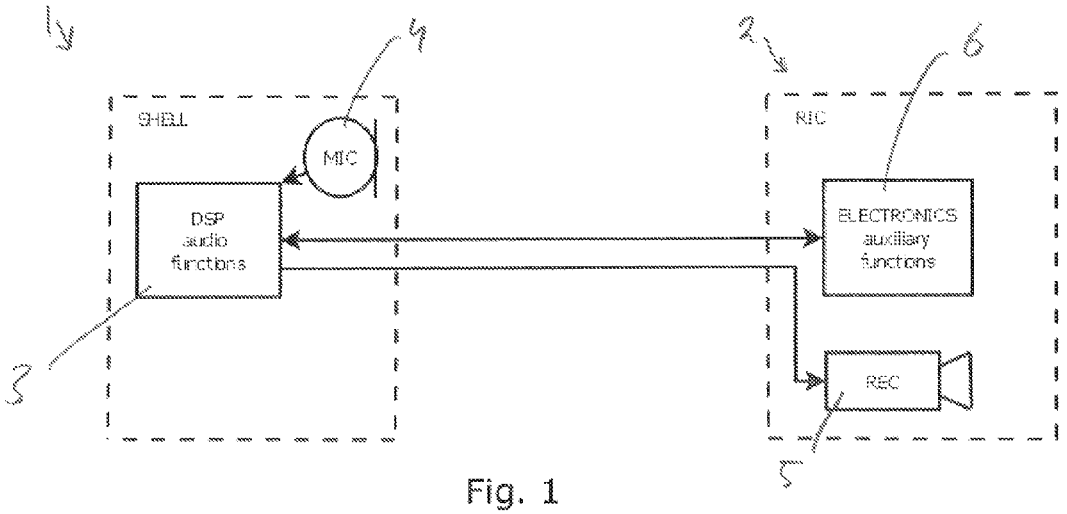
FIG. 1 shows a schematic diagram of a hearing aid according to an embodiment of the invention.

While the present disclosure is susceptible to various modifications and alternative forms, specific embodiments or aspects have been shown by way of examples in the drawings and will be described in detail herein. It should be understood, however, that the present disclosure is not intended to be limited to the particular forms disclosed. Rather, the present disclosure is to cover all modifications, equivalents, and alternatives falling within the spirit and scope of an invention as defined by the appended claims.

DETAILED DESCRIPTION

FIG. 1 shows a schematic diagram of a hearing aid assembly with a first part 1 and a second part 2. The first part is a Behind-the-Ear part 1 and the second part is an In-the-Ear (ITE) part 2. The Behind-the-Ear (BTE) part comprises a Digital Signal Processor 3 (DSP) for processing a sound signal picked up by a microphone 4 and supplying it to a receiver 5 provided in the In-the-Ear part. The In-the-Ear part comprises an electronic-auxiliary-function-unit 6 (EAF Unit).

Figure 2:
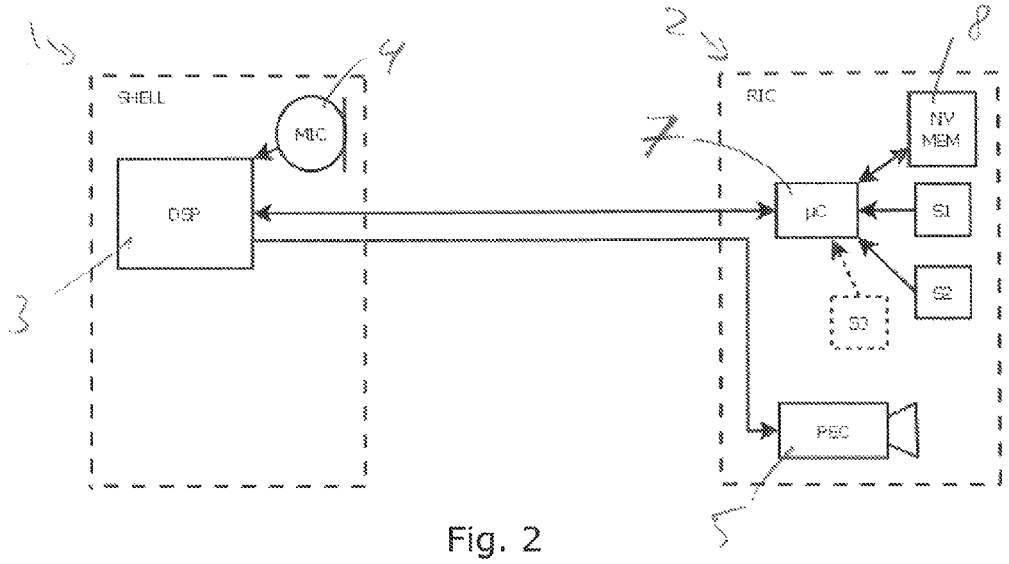
FIG. 2 shows a schematic diagram of a hearing aid according to another embodiment of the invention.

FIG. 2 shows a schematic diagram similar to FIG. 1 wherein the EAF-unit is provided as a microcontroller 7 which is able to read one or more sensors S1, S2, S3 and has access to a non-volatile memory 8. In this memory 8 an identification string, e.g. a string of numbers or letters or a combination thereof, that represents the RIC module 2 (i.e. ITE-part) or the specific receiver 5 present in the RIC-module 2 can be stored. Also sensor information from the sensors S1, S2, S3 and hearing aid usage information can be stored in this memory 8. The DSP 3 can request information from the microcontroller 7, such as the identification string or sensor information. It is also possible to arrange the microcontroller 7 for supplying a control signal for the power state of the DSP 3. Instead of a microcontroller any other type of suitable circuit may be provided.

Figure 3:
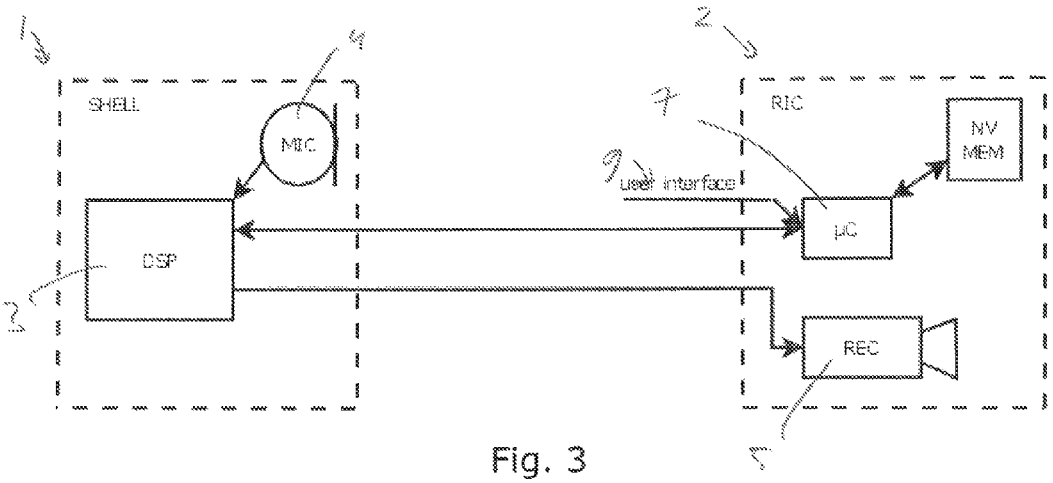
FIG. 3 shows a schematic diagram of a hearing aid according to yet another embodiment of the invention.

FIG. 3 shows a schematic diagram similar to FIG. 1 wherein the EAF-unit is provided as a microcontroller 7 that processes signals generated through a user interface 9. The user interface 9 may be an on/off switch, a volume control or a program selection knob. The electronic-auxiliary-function-unit, in this embodiment the microcontroller 7, performs or enables at least a second function. This second function may be to hold an identification string that can be read by the DSP. This identification number identifies the type of RIC-module, making identification by reading a resistor in the RIC obsolete.

Figure 4:
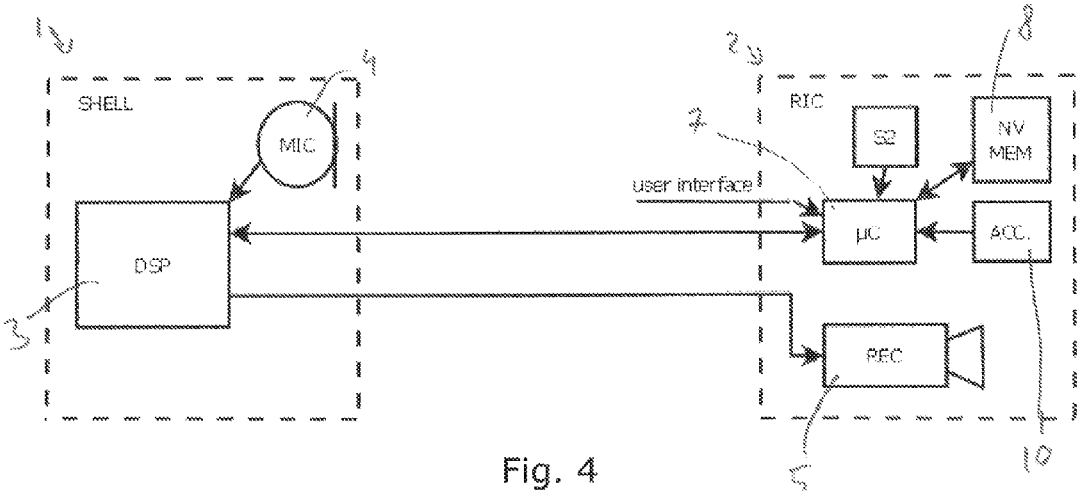
FIG. 4 shows a schematic diagram of a hearing aid according to another embodiment of the invention.

FIG. 4 shows a schematic diagram similar to FIG. 1 wherein RiC-module 2 comprises a microcontroller 7 and an accelerometer 10. The microcontroller firmware will provide for the processing of user interface signals. The accelerometer 10 and optionally a second sensor S2 will provide information to the microcontroller 7 about the location of the hearing aid. The location information indicates e.g. whether the hearing aid is in the ear, laid down on a table, or falling down. The microcontroller 7 will execute an algorithm and control the power mode of the DSP according to the information of the sensors: S2 and the accelerometer 10. This facilitates an auto on/off or an automatic sleep mode of the hearing aid.

In accordance with FIG. 3, the at least further function to be performed or enabled by the electronic-auxiliary-function-unit 6 may be a variety of functions as further described below.

To enable free fall detection, crash detection or damage prevention, the electronic-auxiliary-function-unit is further arranged for processing a free fall detection signal. Falling can damage a receiver. The shock that comes with the touch of the ground can deform the internal parts of the receiver. An acceleration sensor in the RIC detects the falling of the receiver. Such event or other shock could be stored in the non-volatile memory for later review. This information could also be used to warn the user to replace the RIC if it has fallen too often. Another function would be to use the fall information to bring the receiver in a state that it cannot be damaged by a shock/fall.

To enable to register lifetime, the electronic-auxiliary-function-unit is further arranged for storing a start of use date and monitoring time of use. At this moment RIC-modules often have unlimited guarantee. If it is broken it is replaced for free. It could be useful to know when a RIC module was used for the first time and how often it was used. This is e.g. implemented by storing this information in the non-volatile memory 8 of the RIC-module. This allows the manufacturer or acoustician to read back this information when the RIC hearing aid returns from the field.

To enable volume detection and perform a receiver self test the electronic-auxiliary-function-unit is further arranged for processing a receiver self-test signal. The receivers in the RIC-module may deviate from their initial performance on the day of production. If the receiver deteriorates in the field it is advantageous if the user is warned to replace the RIC-module because of an underperforming receiver. This functionality is executed by the electronics in the RIC, a self test by measuring the volume of the receiver.

AS the RIC-module is placed inside the ear which environment is detrimental to the RIC-module, detection and registration of temperature, humidity, wax and other parameters are relevant for preventing and/or solving RIC problems. Such environmental parameters can be picked up by sensors S1, S2, S3 and processed by the electronic-auxiliary-function-unit which thereto is further arranged for processing and storing such environmental signals. There are several causes for receiver failure. A function of the electronics in the RIC-module is to measure parameters that play a role in failure of the receiver. The measured values are stored in the non-volatile memory of the RIC-module for later examination if the receiver is returned to the factory or shop. Another feature is warning the user if the sensor measures dangerous values, for example high humidity, or warn the user if the receiver has to be returned because of bad performance caused by substances, such as wax in the receiver.

Another function that can be performed by the electronics in the RIC-module is processing of signals from a capacitive switch. Such capacitive switch can be used as a user interface or to detect whether the RIC-module is in the ear. Thereto the electronic-auxiliary-function-unit is further arranged for processing a capacitive switch signal.

To perform pressure detection for a balloon ear dome or in ear detection, the electronic-auxiliary-function-unit is further arranged for processing a pressure signal. When a balloon ear dome is used, a pressure sensor can be controlled and read by the electronics in the RIC. A pressure sensor measures the pressure in the balloon. In this way it is possible to detect whether it is necessary to inflate the balloon. Also a detection circuit could be incorporated in the RIC-module to determine whether the RIC-module is in the ear or not. This information can be used to determine whether a balloon has to be inflated (RIC inserted into the ear) or deflated (RIC removed from the ear).

Sensors in the ear could be used to do medical measurements. These sensors are then controlled by the electronics in the RIC-module. The information could be stored in the non-volatile memory for later reading or be send to a doctor or user by means of audio signals or RF. An example of a medical measurement is determination of heart beat rate. Thereto the electronic-auxiliary-function-unit is further arranged for processing a heart beat rate signal.

To enable Snore detection, i.e. the snoring of the user of the hearing aid, the electronic-auxiliary-function-unit is further arranged for processing a snore detection signal. This detection signal is processed to determine whether the DSP or even the hearing aid can be switch off. The signal can also be used to warn the user to stop e.g. by means of an audio signal or vibration. The snore detection information can also be stored in the RIC-module for later reading to assess whether the user gets enough sleep or evaluating sleeping habits.

To enable a user interface for acknowledgement of questions or instructions by turning of the head, the electronic-auxiliary-function-unit is further arranged for processing a gyroscope sensor signal. Gyro sensors in the RIC-module are used to detect the turning of the head. Such movement of the head is used to answer questions presented to the user by means of speech through the hearing aid by nodding yes or no.

In another embodiment the electronic-auxiliary-function-unit is further arranged for processing a movement detection signal. Movement sensors, such as acceleration sensors, placed in the RIC-module provide extra information to determine in which situation the user is. The movement detection signal is processed to allow desired program determination. The acoustical program of the hearing aid is then adapted to the user situation.

In another embodiment, a vibrator is placed in the RIC-module to provide tactile feedback of the user interface. This vibrator is controlled by the electronics of the RIC-module. Thereto the electronic-auxiliary-function-unit is further arranged for processing a tactile feedback signal. This may implemented regardless of whether the electronics in the RIC-module is arranged for interaction with the user interface sensors.

In still another embodiment, the electronic-auxiliary-function-unit is further arranged for supplying a hearing aid status information signal. The electronics in the RIC-module may collect and store information relevant to send to a user, acoustician, manufacturer or medical examiner. This may be done by means of a telephone connection or wireless connection. The hearing aid status information signal may represent device information, audio streaming or control signals for another hearing aid device e.g. from left hearing aid device to right ear hearing aid device or to a remote control device or the like.

The invention claimed is:

1. A hearing aid assembly comprising a first part being a behind-the-ear part and a second part being an In-the-Ear part, the first part comprising a DSP, the second part comprising an electronic-auxiliary-function-unit and a receiver, wherein the electronic-auxiliary-function-unit includes a microcontroller and is arranged for storing an identification string representing the receiver, and wherein the DSP is configured to request the identification string from the microcontroller and adapt audio processing for the receiver based on the received identification string.

2. A hearing aid assembly according to claim 1, wherein the electronic-auxiliary-function-unit is further arranged for processing a free fall detection signal.

3. A hearing aid assembly according to claim 1, wherein the electronic-auxiliary-function-unit is further arranged for storing a start date and life time.

4. A hearing aid assembly according to claim 1, wherein the electronic-auxiliary-function-unit is further arranged for processing a receiver self-test signal.

5. A hearing aid assembly according to claim 1, wherein the electronic-auxiliary-function-unit is further arranged for processing and storing environmental signals.

6. A hearing aid assembly according to claim 1, wherein the electronic-auxiliary-function-unit is further arranged for processing a capacitive switch signal.

7. A hearing aid assembly according to claim 6, wherein the capacitive switch signal is used as a user interface or to detect whether the In-the-Ear part is in an ear.

8. A hearing aid assembly according to claim 1, wherein the electronic-auxiliary-function-unit is further arranged for processing a pressure signal.

9. A hearing aid assembly according to claim 1, wherein the electronic-auxiliary-function-unit is further arranged for processing a heart beat rate signal.

10. A hearing aid assembly according to claim 1, wherein the electronic-auxiliary-function-unit is further arranged for processing a snore detection signal.

11. A hearing aid assembly according to claim 1, wherein the electronic-auxiliary-function-unit is further arranged for processing a gyroscope sensor signal.

12. A hearing aid assembly according to claim 1, wherein the electronic-auxiliary-function-unit is further arranged for processing a movement detection signal.

13. A hearing aid assembly according to claim 1, wherein the electronic-auxiliary-function-unit is further arranged for supplying a tactile feedback signal.

14. A hearing aid assembly according to claim 1, wherein the electronic-auxiliary-function-unit is further arranged for supplying a hearing aid status information signal.

15. A hearing aid assembly according to claim 1, wherein the identification string is readable by the DSP.

16. A hearing aid assembly according to claim 1, wherein the microcontroller is adapted to control a power mode of the DSP.

17. A hearing aid assembly according to claim 16, wherein the power mode comprises an automatic on/off mode and/or an automatic sleep mode.

* * * * *